US005819318A

United States Patent [19]

Tse

[11] Patent Number: 5,819,318

[45] Date of Patent: Oct. 13, 1998

[54] HEAD COVERING WITH ADJUSTABLE SUNSHADE VISOR AND INSIDE VENTILATION

[75] Inventor: Steven Tse, 4Fl.27, Lane 160, Taipei Hsin Sheng S. Rd. Sec.1, Taiwan

[73] Assignees: Steven Tse; Meng Chin Tseng, both of Taiwan

[21] Appl. No.: 951,367

[22] Filed: Oct. 16, 1997

[51] Int. Cl.[6] ..... A42C 5/04

[52] U.S. Cl. ..... 2/182.1; 2/10; 2/181; 2/183; 2/195.1; 2/195.2; 2/195.5; 2/209.7; 2/DIG. 1

[58] Field of Search ..... 2/171, 175.1, 175.4, 2/181, 182.1, 182.3, 182.7, 182.8, 183, 195.1, 195.2, 195.5, 418, DIG. 1, 10, 209.7

[56] References Cited

U.S. PATENT DOCUMENTS

| | | | |
|---|---|---|---|
| 707,784 | 8/1902 | Johnson | 2/182.3 |
| 1,988,101 | 1/1935 | Wittcoff | 2/209.7 |

*Primary Examiner*—Diana Biefeld
*Attorney, Agent, or Firm*—Bacon & Thomas

[57] ABSTRACT

A head covering is provided with an adjustable sunshade visor for shielding the wearer's face from sunshine and an inside ventilation means for supplying air to the inside of the head covering to cool the wearer's head in hot days. The head covering includes a frame; a substantially C-shaped rim made of flexible material mounted on the bottom of the frame. A size adjusting belt is joined to the C-shaped rim in such a manner as to form a ring that fits on a wearer's head, the diameter of the ring being adjustable by adjusting the length of the size adjusting belt. A plurality of tubular members having hollowed inside are mounted along and between the outer and inner walls of the C-shaped rim. A double-layer crown-structure including an outer fabric layer and an internal net-like layer is supported on the frame for covering the wearer's head. The outer fabric layer and the internal net-like layer are separated by a gap that serves as an air passage. An air-inlet structure is formed with at least one vent and located on the top of the head covering, which allows wind to flow into the air passage to cool the wearer's head. Moreover, the head covering includes an adjustable face mask serving as a sunshade visor that can be adjusted to various positions to protect any parts of the wearer's head from being exposed to the sunshine.

5 Claims, 4 Drawing Sheets

HEAD COVERING WITH ADJUSTABLE SUNSHADE VISOR AND INSIDE VENTILATION

BACKGROUND OF THE INVENTION

1. Field of the Invention

This invention relates in general to a head covering, such as a hat or cap, which is provided with an adjustable face mask serving as a sunshade visor for shielding the wearer's face from sunshine and an inside ventilation means for supplying air to the inside of the head covering to cool the wearer's head in sultry days.

2. Description of Related Art

When walking or playing outdoors in sunshine days, such as playing golf, baseball, tennis, a person usually wears a hat that can prevent his/her head or face from exposing to the sunshine which may otherwise cause sunburn, sunstroke, or even skin cancer to that person. Conventional hats can serve as a good sunshade to the wearer. However, most conventional hats cover the wearer's head in a manner of tight contact that can cause impediment to the perspiration in the wearer's head. The wearer may thus suffer from a sweltering condition in his/her head.

Some conventional hats are formed with a plurality of holes in the crown so that part of the wearer's head covered by the hat can be exposed, which allows the evaporation of the sweat in the wearer's head to the atmosphere. However, with this solution, most of the wearer's head is still covered by the hat that would suffer from an impediment to the perspiration. There exists, therefore, a need for a head covering that is provided with an air passage that can expose all of the wearer's head being covered by the hat to air or a flowing stream of air.

Some conventional head coverings are provided with an air passage on the inside. However, these head coverings are mostly helmet-type that are made of hard and heavy plastics, and therefore are not suitable for casual wearing such as when playing tennis. There exists, therefore, a need for a new head covering which is provided with an air passage on the inside thereof and which is made of soft and light fabrics for casual wearing.

SUMMARY OF THE INVENTION

It is therefore a primary objective of the present invention to provide a head covering which is provided with ventilation means to the inside thereof and an air passage on the inside of the head covering to that the wearer's head covered by the head covering can be always exposed to air or a flowing stream of air to evaporate his/her sweat to the atmosphere.

It is another objective of the present invention to provide a head covering which is provided with an adjustable face mask that can be adjusted to various positions so as to protect any of the wearer's head parts from being exposed to the sunshine that would otherwise cause sunburn or even skin cancer.

It is still another objective of the present invention to provide a head covering which is provided with an air passage that not only can allow air to flow over the wearer's head, but also can serve as a heat-insulating air gap that blocks the direction transmission of heat from the sunshine radiation to the wearer's head.

In accordance with the foregoing and other objectives of the present invention, a new head covering is provided. The head covering of the invention includes a frame; a substantially C-shaped rim made of flexible material mounted on the bottom of said frame, said C-shaped rim being a double-wall structure including an outer wall and an inner wall; a size adjusting belt joined to said C-shaped rim in such a manner as to form a ring that fits on a wearer's head, the diameter of said ring being adjustable by adjusting the length of said size adjusting belt; a plurality of tubular members having hollowed inside and mounted along and between the outer and inner walls of said C-shaped rim; a double-layer crown-structure including an outer fabric layer and an internal net-like layer supported on said frame, said outer fabric layer and said internal net-like layer being separated by a gap serving as an air passage; and an air-inlet structure having at least one vent formed on the top of said head covering, said air-inlet structure allowing air to flow into said air passage.

The head covering of the invention is provided with internal ventilation means that allows wind to be guided and flow into the inside of the head covering, thereby providing a cooling effect to the wearer's head. Moreover, the double-layer crown structure of the head covering including an outer fabric layer and an internal net-like layer not only provides an air passage that supplies flowing air to the wearer's head, but also provides a heat-insulating gap that can prevent the heat from the sunshine striking on the outer fabric layer to be transmitted to the wearer's head. Moreover, the adjustable face mask serves as a sunshade visor that can be adjusted to various positions to protect any of the wearer's head parts from being exposed to the sunshine.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
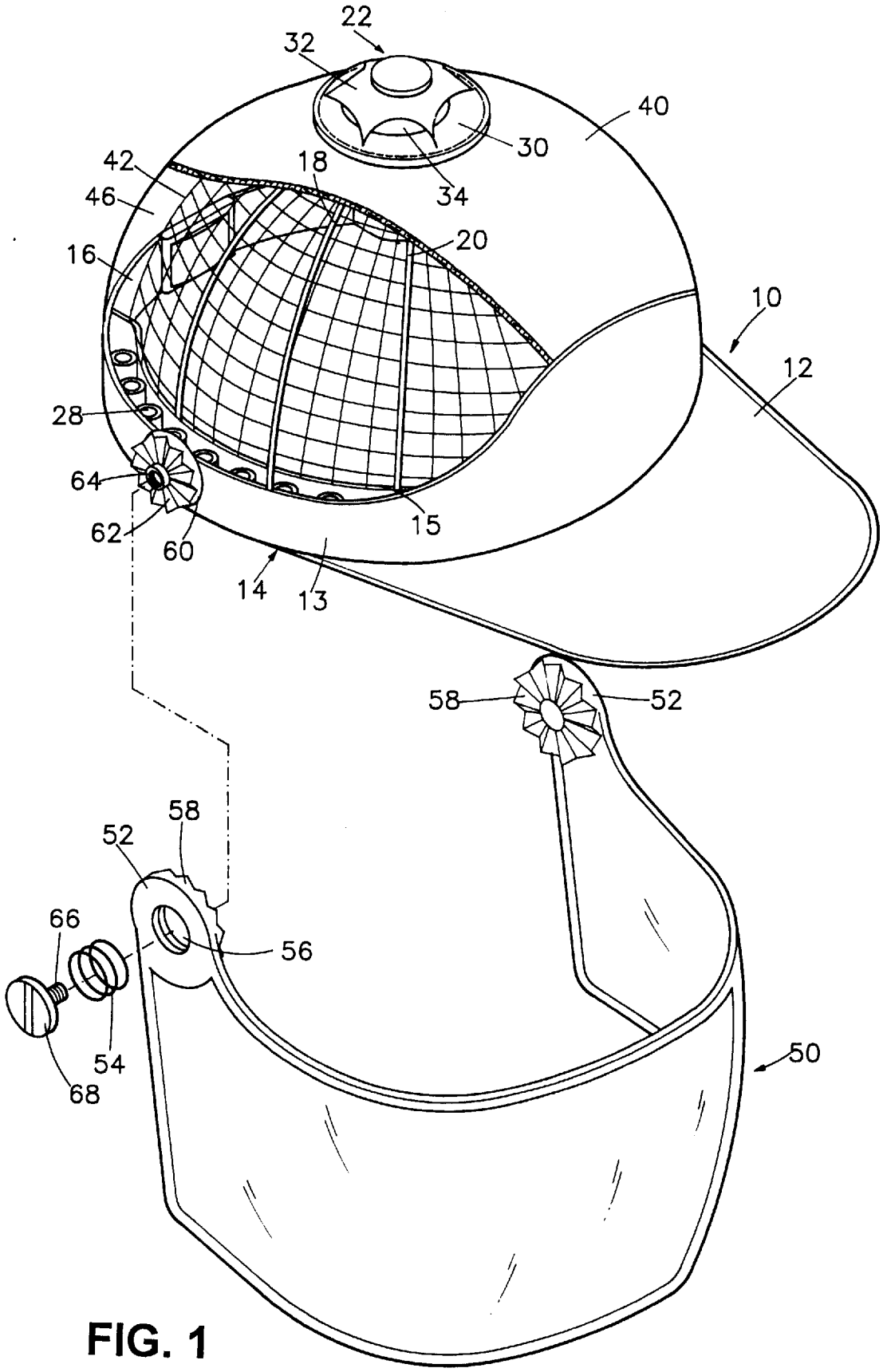
FIG. 1 is an exploded perspective view of the head covering of the invention with part removed to show the inside structure.
Figure 2:
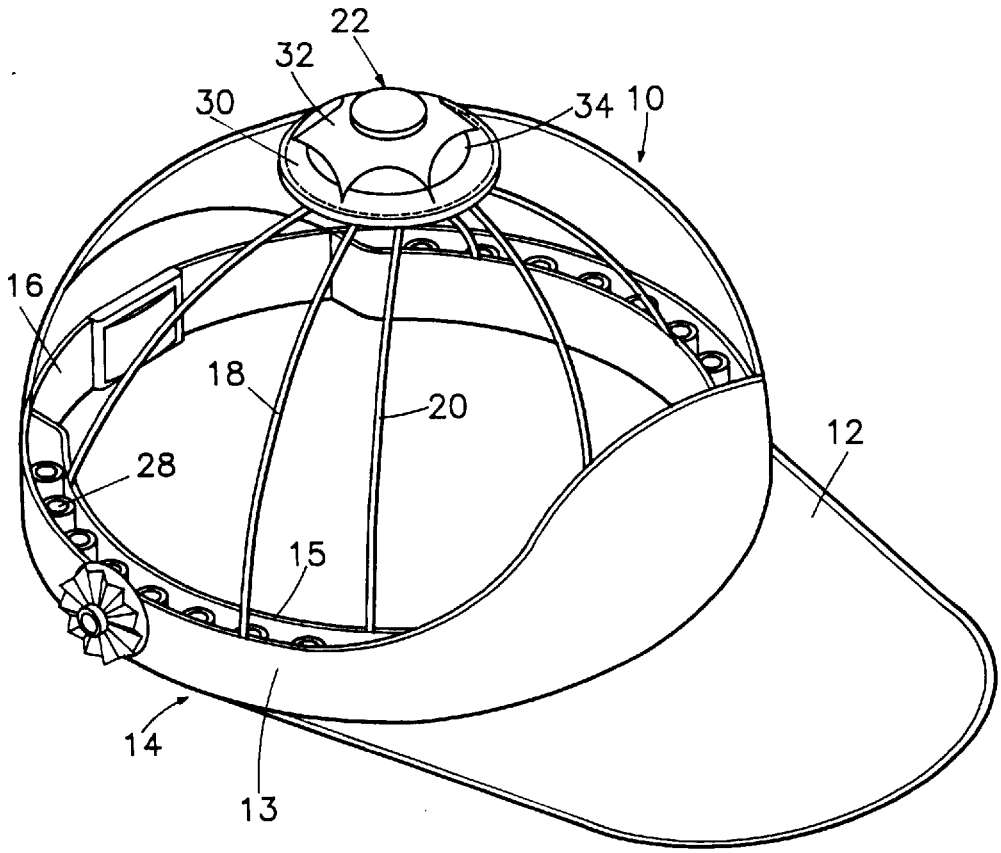
FIG. 2 is a perspective view of the head covering of the invention with part removed to show the inside structure.
Figure 3:
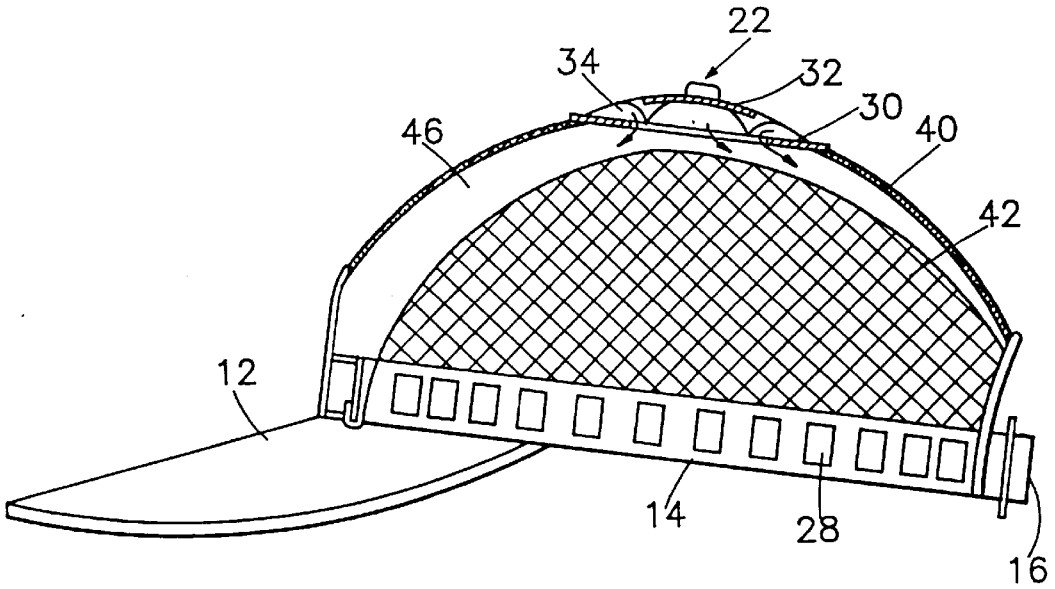
FIG. 3 is a side view of the head covering of the invention.
Figure 4:
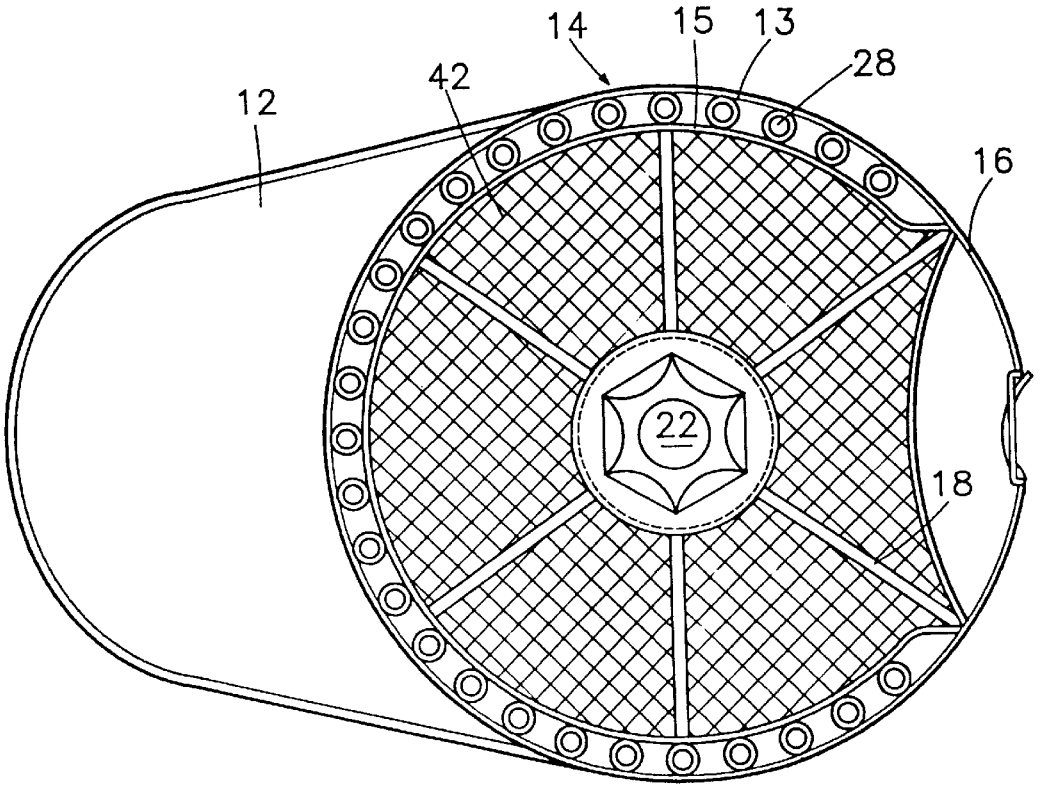
FIG. 4 is a top view of the head covering of the invention.

Referring to FIG. 1, the head covering of the invention includes a frame 10, an outer fabric layer 40, an internal net-like layer 42, and an adjustable face mask 50.

Referring to FIGS. 1 through 4, the frame 10 is an integrally formed structure of a soft, light, and durable fabric, such as nylon or pure PV, made by mold injection. The frame 10 further includes a brim 12, a substantially C-shaped rim 14, a size adjusting belt 16, an external rib-like structure 18, an internal rib-like structure 20, and an air-inlet structure 22. The C-shaped rim 14 has a front edge joined to the tail edge of the brim 12. The size adjusting belt 16 has two ends joined to the two ends of the C-shaped rim 14. The size adjusting belt 16 is adjustable in length, whereby the diameter of the C-shaped rim 14 can be adjusted so as to allow the wearer to fit the head covering snugly on his/her head. The C-shaped rim 14 is a double-wall structure including an outer wall 13 and an inner wall 15. A plurality of suitably spaced tubular members 28 are embedded and oriented in an upright manner in the C-shaped rim 14 between the outer and inner walls 13, 15 thereof. These tubular members 28 are made of soft, flexible, and elastic material. When the C-shaped rim 14 is reduced in diameter to fit the wearer's head more tightly, these tubular members 28 will be compressed, and the flexibility and elasticity of these tubular members 28 will allow the head covering to be more snugly and comfortable fit on the wearer's head, without incurring stress on the wearer's head. It also allows the head covering to be more securely fit on the wearer's head without being, for example, blown away by strong wind.

Further, the outer wall 13 of the C-shaped rim 14 is extended to form the external rib-like structure 18, and the inner wall 15 is extended to form the internal rib-like structure 20. The top of the external rib-like structure 18 is joined to the air-inlet structure 22 at the top of the head covering, and so is the internal rib-like structure 20. The external rib-like structure 18 is used to support the outer fabric layer 40 thereon, and the internal rib-like structure 20 is used to support the internal net-like layer 42 thereon. The air-inlet structure 22 includes a ring-shaped base plate 30 and a polygon-shaped member 32 mounted on the base plate 30. A plurality of vents 34 are formed between the base plate 30 and the polygon-shaped member 32. These vents 34 are formed in such a manner that their entrance is vertically oriented when the head covering is wearing upright on a person's head. This arrangement allows the air to be easily blown into the inside of the head covering through these vents 34 when there is wind or when the wearer is moving, while preventing sunshine to pass through the same to the inside of the head covering.

The outer fabric layer 40 and the internal net-like layer 42 in combination constitute a double-layer crown structure for the head covering. The outer fabric layer 40 is preferably made of soft, light, and durable fabrics such as non-woven fabric. Moreover, the outer fabric layer 40 is preferably made of waterproof and heat-insulating material. More preferably, the outer fabric layer 40 is coated with a layer of anti-violet material. The internal net-like layer 42 is the only part of the head covering that will come into touch with the wearer's head, so that it is preferably made of soft and smooth material that allows comfort to the wearer's head. The outer fabric layer 40 is seamed by ultrasound knitting machine to between the outer wall 13 of the C-shaped rim 14 and the external rib-like structure 18, while the internal net-like layer 42 is seamed to between the inner wall 15 of the C-shaped rim 14 and the internal rib-like structure 20. The internal net-like layer 42 is preferably extended to the beneath of the inner wall 15 of the C-shaped rim 14, so that it can be the only part of the head covering that comes in touch with the wearer's head. With this arrangement, the outer fabric layer 40 and the internal net-like layer 42 are separated by a gap that serves an air passage 46 connected to the vents 34 on the air-inlet structure 22. This air passage 46 covers the wearer's head. Therefore, the wind blowing through the air-inlet structure 22 into this air passage 46 thus can provide a brushing and cooling effect to the wearer's head. The wind will then exit the head covering through the gap in the C-shaped rim 14 and the hollowed inside of the tubular members 28. This allows an air flow from the air-inlet structure 22 to the bottom of the head covering that brushes over the wearer's head, thus providing a comfortable cooling effect to the wearer's head in hot days. Moreover, the outer fabric layer 40 can prevent the sunshine from penetrating therethrough to the wearer's head, thus preventing the wearer's head from sunburn or being subjected to ultraviolet radiation that could cause skin cancer.

In another embodiment, the external rib-like structure 18 and the internal rib-like structure 20 can be eliminated, instead, the outer fabric layer 40 is directly seamed to between the outer wall 13 of the C-shaped rim 14 and the air-inlet structure 22, while the internal net-like layer 42 is directly seamed to the inner wall 15 of the C-shaped rim 14. This embodiment has the benefit of folding easily for storage or carrying on the go. Moreover, when wearing the head covering, the internal net-like layer 42 and the outer fabric layer 40 can come out in the dome-like shape so that the head covering can be readily fit onto the wearer's head. It also allows the air passage 46 to be formed between the internal net-like layer 42 and the outer fabric layer 40.

Figure 5:
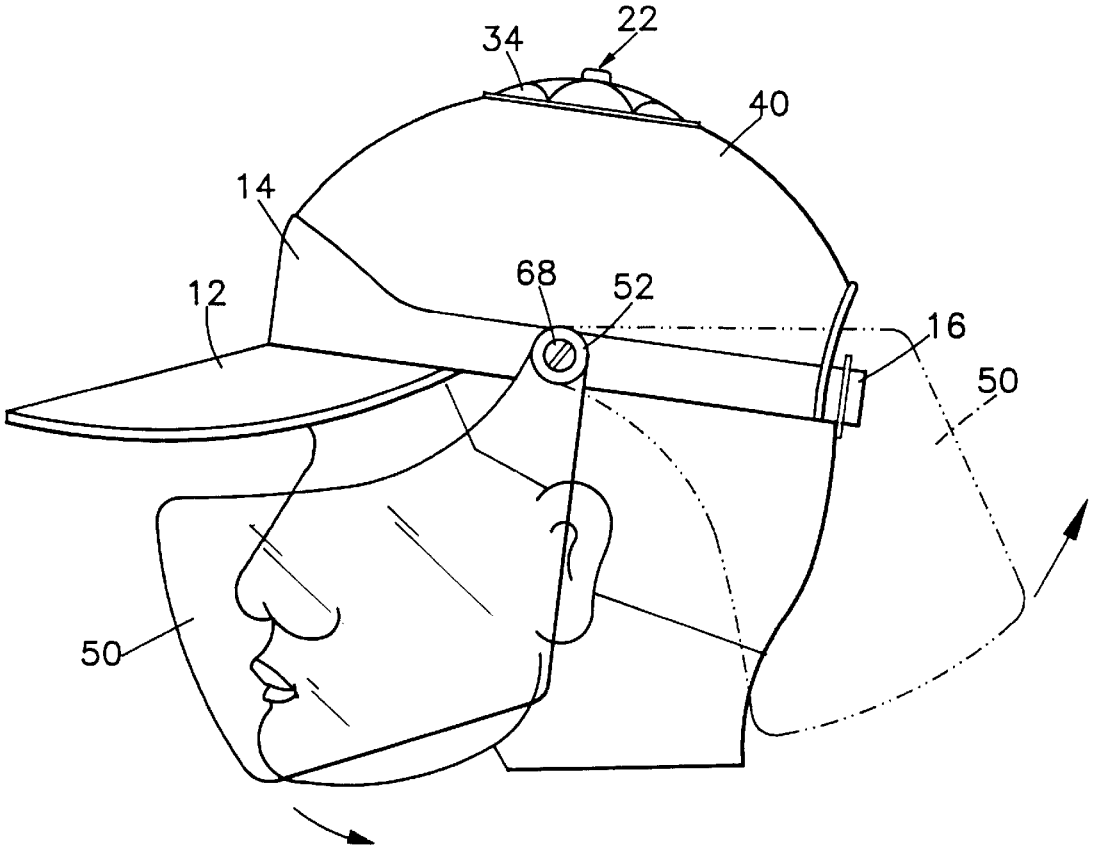
FIG. 5 is a schematic diagram showing the wearing of the head covering of the invention on a person's head.

Referring to FIG. 1 together with FIG. 5, the head covering of the invention further includes an adjustable face mask 50 pivotally connected to both sides of the C-shaped rim 14, which is specifically designed to serve as a sunshade visor to the head covering. The adjustable face mask 50 is formed with two ear-like portions 52 on both sides, each being formed with a through hole 56 therein and a toothed surface 58 surrounding the hole 56 on the inside surface thereof. Correspondingly on the outer wall 13 of the C-shaped rim 14, a pair of mounts 60 (only one is shown in FIG. 1 and FIG. 5) are provided on both sides of the head covering, each being used to mount one of the ear-like portions 52 of the adjustable face mask 50. Each mount 60 is formed with a protruded tubular piece 64 having a threaded bore and a toothed surface 62 surrounding the tubular piece 64. The toothed surface 62 on the mount 60 is shaped in such a manner as to be meshable to the corresponding toothed surface 58 on the ear-like portions 52 of the adjustable face mask 50.

When coupling the adjustable face mask 50 onto the mount 60, the first step is to fit the through hole 56 in the ear-like portions 52 of the adjustable face mask 50 to the tubular piece 64 on the mount 60 and mesh the toothed surface 58 on the adjustable face mask 50 to the toothed surface 62 on the mount 60; then sleeve an elastic member, such as a spring 54, whose outer diameter is less than that of the through hole 56 and whose inner diameter is greater than that of the tubular piece 64, on the tubular piece 64; and finally drive a screw 66, whose head 68 is larger in diameter than the hole 56, through the hole 56 into the threaded bore of the tubular piece 64. This allows the adjustable face mask 50 to be securely mounted on the mount 60. The large head 68 of the screw 66 can prevent the adjustable face mask 50 from detaching from the mount 60. The meshing of the two toothed surfaces 58 and 62 allows the adjustable face mask 50 to be fixed at a certain desired angle adjusted by the wearer. When the wearer wishes to adjust the adjustable face mask 50 to another position, he/she can push the two sides of the adjustable face mask 50 by hands outwards, whereby the meshing of the two toothed surfaces 58 and 62 is disengaged, and then turn the adjustable face mask 50 to the desired angle. After releasing the adjustable face mask 50, the toothed surface 58 on the adjustable face mask 50 will be meshed to the toothed surface 62 on the mount 60 due to the elasticity of the spring 54. Therefore, the wearer can freely adjust the adjustable face mask 50 to any position suitable to shield the sunshine from various directions. For instance, when the sunshine comes from the front, the adjustable face mask 50 can be adjusted to cover the face of the wearer, as illustrated in FIG. 5; and when the sunshine comes from behind, the adjustable face mask 50 can be adjusted to the rear position, as illustrated by the broken line in FIG. 5, so as to protect the wearer's back head from exposing to the sunshine.

In conclusion, the head covering of the invention is provided with internal ventilation means that allows wind to be guided and flow into the inside of the head covering, thereby providing a cooling effect to the wearer's head. Moreover, the double-layer crown structure of the head covering including an outer fabric layer 40 and an internal net-like layer 42 not only provides an air passage 46 that supplies flowing air to the wearer's head, but also a heat-insulating gap that can prevent the heat from the sunshine striking on the outer fabric layer 40 to be transmitted to the wearer's head. Moreover, the adjustable face mask 50 serves as a sunshade visor that can be adjusted to various positions to protect any of the wearer's head parts from being exposed to the sunshine.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A head covering, comprising:

a frame;

a substantially C-shaped rim made of flexible material mounted on a bottom of said frame, said C-shaped rim being a double-wall structure including an outer wall and an inner wall;

a size adjusting belt joined to said C-shaped rim in such a manner as to form a ring that fits on a wearer's head, the diameter of said ring being adjustable by adjusting the length of said size adjusting belt;

a plurality of tubular members having hollowed insides and mounted along and between the outer and inner walls of said C-shaped rim;

a crown-structure including an outer fabric layer and an internal net-like layer supported on said frame, said outer fabric layer and said internal net-like layer being separated by a gap serving as an air passage; and an air-inlet structure having at least one vent formed on a top of said head covering, said air-inlet structure allowing air to flow into said air passage.

2. The head covering of claim 1, wherein the outer wall of said C-shaped rim is extended to form an external rib-like structure including a plurality of ribs arranged in a radiated manner and joined at the air-inlet structure on the top of said head covering, said external rib-like structure being used to support said outer fabric layer.

3. The head covering of claim 1, wherein the inner wall of said C-shaped rim is extended to form an internal rib-like structure including a plurality of ribs arranged in a radiated manner and joined at the air-inlet structure on the top of said head covering, said internal rib-like structure being used to support said internal net-like layer.

4. The head covering of claim 1, further comprising:

a pair of mounts provided on both sides of said C-shaped rim; and a face mask rotably coupled to said mounts;

wherein each of said mounts includes:

a tubular piece having a threaded bore; and a toothed surface surrounding said tubular piece;

and wherein said face mask includes:

a pair of ear-like portions, each being formed with a hole and a toothed surface surrounding said hole;

a pair of springs, each being less in diameter than the hole in each of the ear-like portions of said adjustable face mask; and a pair of screws, each having a threaded portion less in diameter than said springs, each screw being used in conjunction with one of said springs to be screwed via said hole in one of said ear-like portions into the threaded bore of said tubular piece on one of said mounts in such a manner that the associated spring is sleeved on the threaded portion of said screw and that the toothed surfaces on said ear-like portions of said adjustable face mask are meshed to the toothed surfaces on said mounts.

5. The head covering of claim 1, wherein said outer fabric layer is made from non-woven nylon which is coated with an anti-violet material.

* * * * *